US006363755B1

(12) United States Patent
Hapke et al.

(10) Patent No.: US 6,363,755 B1
(45) Date of Patent: Apr. 2, 2002

(54) TIMED RELEASE WASHING MACHINE LID LOCK

(75) Inventors: Kenyon A. Hapke, Libertyville; Timothy Laseke, New Berlin, both of WI (US)

(73) Assignee: Ark-Les Corporation, Stoughton, MA (US)

( * ) Notice: Subject to any disclaimer, the term of this patent is extended or adjusted under 35 U.S.C. 154(b) by 0 days.

(21) Appl. No.: 09/456,117

(22) Filed: Dec. 7, 1999

(51) Int. Cl.[7] ..... D06F 33/02
(52) U.S. Cl. ..... 68/12.26; 210/146; 292/DIG. 69
(58) Field of Search ..... 68/12.26, 23 R, 68/13 R, 196; 292/DIG. 69; 210/146; 192/136

(56) References Cited

U.S. PATENT DOCUMENTS 3,638,457 A * 2/1972 Filipak
3,696,903 A * 10/1972 Nethersell
4,072,867 A * 2/1978 Goodlaxon
4,120,013 A * 10/1978 Simmons
4,179,907 A 12/1979 Schantz ..... 68/12 R
4,286,811 A 9/1981 Schantz ..... 292/201
4,365,830 A * 12/1982 Paulson
4,932,707 A * 6/1990 Ekstran
4,996,650 A 2/1991 Schantz et al. ..... 292/201
5,398,528 A * 3/1995 Johnson et al.
5,520,424 A * 5/1996 Hapke et al.
5,600,976 A 2/1997 Hapke et al. ..... 68/12.26
5,691,520 A 11/1997 Hapke et al. ..... 200/61.62
5,728,985 A 3/1998 Hapke et al. ..... 200/61.62
5,799,281 A * 8/1998 Login et al.
5,823,017 A * 10/1998 Hapke et al.

* cited by examiner

*Primary Examiner*—Frankie L. Stinson
(74) *Attorney, Agent, or Firm*—Quarles & Brady LLP

(57) ABSTRACT

A lid lock for a washing machine or the like employs a rapid bistable electromagnetic actuator that is released at a predetermined time interval after the cessation of a spin signal, the time interval being selected to allow the spin basket to coast to a stop prior to the lid being unlocked. Because the actuator is bistable, it can remain locked despite possible power failure during which the spin basket may still be coasting yet the driving circuitry stores reserved power to unlock the lid after a suitable time delay. These same components can provide protection against entrapment in which the lid closure activates the spin cycle and lock because of a previous initiation of the spin cycle signal. Here, for the spin cycle to be initiated, the spin cycle signal must occur after lid closure.

13 Claims, 6 Drawing Sheets

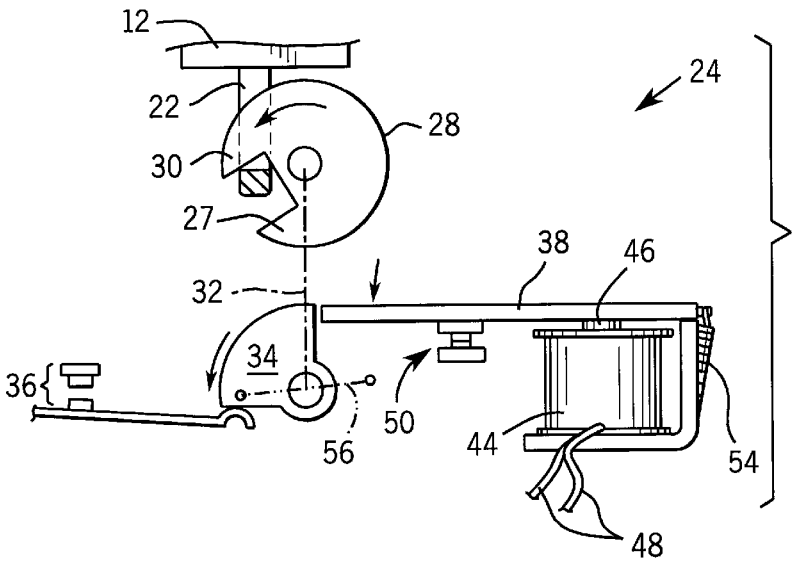
FIG. 4
FIG. 5
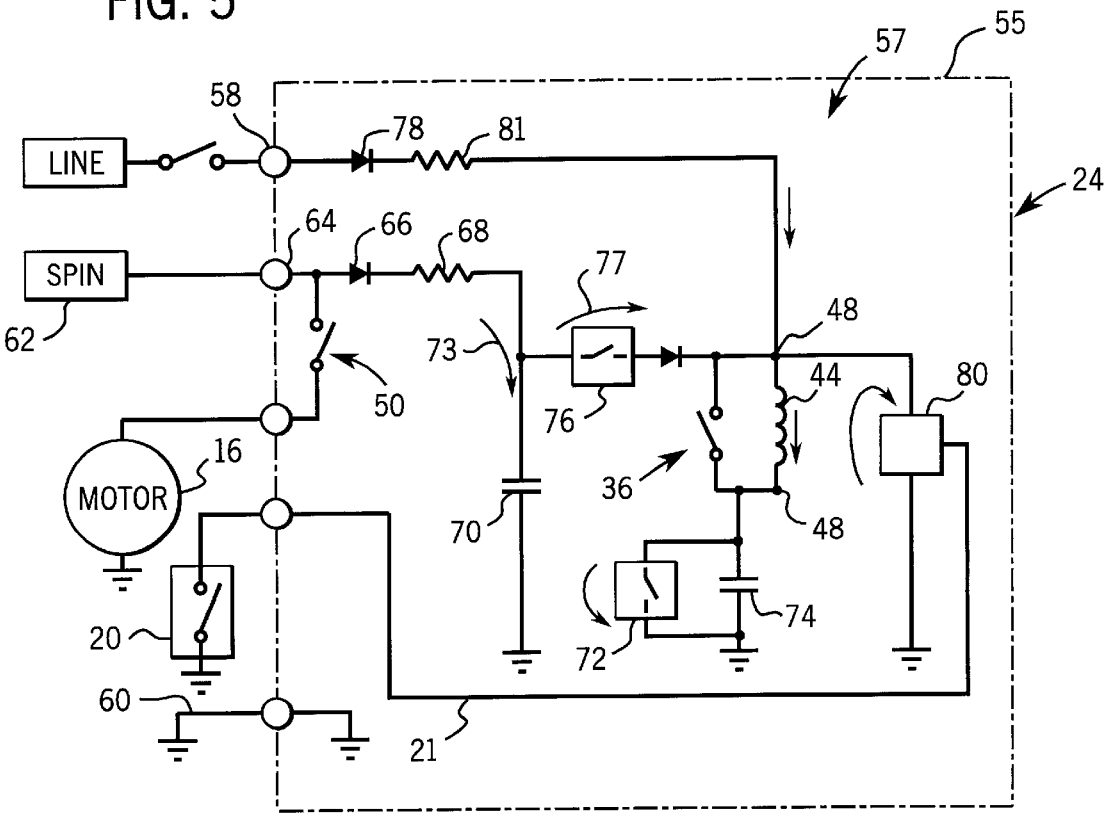

57
80
12V
5.1V
76
48
44
24V
36
72
81
12V
24V
70
78
68
50
66
62
58
16
60
20

100
NEW SPIN CYCLE SIGNAL ?
YES
NO
106
LID CLOSED ?
YES
NO
108
LOCK, AND START MOTOR
102
ROTATION ?
YES
NO
104
UNLOCK
112
SPIN CYCLE SIGNAL ?
YES
NO 46
47
44
48

TIMED RELEASE WASHING MACHINE LID LOCK

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to clothes washing machines and the like and specifically to a lock assembly for preventing access to the spin basket of such a washer during the spin cycle.

During the spin cycle of a washing machine, water is removed from wet clothes centrifugally by spinning the clothes at high speed in a spin basket. In order to reduce the possibility of injury to the user, the user must be prevented from having access to the spin basket while the spin basket is in motion.

One way of protecting the user from access to the rotating spin basket uses a lid switch on the washing machine to detect an opening of the washing machine lid. When the lid is opened by more than a predetermined amount, the lid switch disconnects power from the motor driving the spin basket and activates a brake to bring the rapidly spinning spin basket to a halt. The brake, which is required because of the large rotational momentum of a loaded spin basket, adds significant expense in the manufacture of the washing machine. Systems using brakes may be impractical for future washing machines using higher speed spin cycles to remove greater amounts of water from the wet clothes.

A second way of protecting the user from access to the rotating spin basket uses an electrically actuated lock for the washing machine lid. The lock holds the lid in a closed position for the duration of the spin cycle and for a period after the spin cycle necessary for the spin basket to coast to a stop. The locking mechanism typically uses a thermally actuated element, such as a bi-metallic strip or a wax motor, to position a locking bolt into engagement with the washing machine lid; the bolt prevents the lid from opening. At the conclusion of the spin cycle, the thermally actuated element begins to cool and after a predetermined cooling period, retracts the locking bolt from the washing machine lid and allows the lid to be raised.

The intrinsic delay in the thermally actuated element (required by its need to cool) prevents the lock from being defeated simply by removing power to the washing machine yet in the event of power loss, the lock can be assured of opening on its own after the fixed period of time.

A disadvantage of the thermally actuated element is that it is hard to accurately control the period during which the lid will be locked, the time being affected both by manufacturing tolerance and variations in the temperature of the environment of the washing machine. Further, such a mechanism is difficult to integrate with more sophisticated locking logic, such as systems which operate to reduce the likelihood of child entrapment or misuse of the washing machine. What is needed is an electromechanical locking system that provides the benefits of the thermally actuated element without its disadvantages.

BRIEF SUMMARY OF THE INVENTION

The present invention provides an electromagnetic lid locking mechanism that can release the lid rapidly after a precise interval of time regardless of power failures and which is resistant to being defeated by unplugging the washing machine. The stopping of the spin basket is inferred from the passage of a time interval selected to be longer than a coasting period of the washing machine spin basket. The electromagnetic lid locking mechanism is stable in either the locked or unlocked position when power is removed and hence the lock cannot be defeated by removing power from the washing machine. The circuitry driving the electromagnetic lid locking mechanism monitors and stores electrical power to ensure that the lid may be unlocked at the conclusion of the spin cycle, even if power is lost, reducing the possibility of the lid remaining locked when power fails. The same components and circuitry may be used to provide at small additional cost, a "lock-out" of the spin cycle in situations where a child might intentionally or unintentionally enter the spin basket after the spin cycle has been initiated while the lid is open.

Specifically, the present invention provides a lid locking assembly having a bistable electromagnetic lid locking mechanism that in a locked state, holds the lid closed until an unlock signal is received and in an unlocked state allows the lid to be freely opened until a lock signal is received, where the unlock and lock signals are power applied to the electromagnetic lid locking mechanism and wherein, absent power applied to the electromagnetic lid locking mechanism, the electromagnetic lid locking mechanism remains in its last state of locked and unlocked. The lid locking assembly further includes a logic circuit having a timer and an energy storage capacitor to provide the unlock signal to the electromagnetic lid locking mechanism a predetermined period of time after the cessation of the washing machine's spin cycle signal, wherein the storage capacitor provides energy for the unlock signal in the event of loss of external power to the washing machine.

Thus, it is another object of the invention to reduce the possibility of the electromagnetic lid locking mechanism remaining in the locked state when power is removed from the washing machine. The energy used to lock the electromagnetic lid locking mechanism automatically charges a storage capacitor to provide power for the later unlock signal.

It is another object of the invention to provide an electromagnetic lid locking mechanism that responds rapidly to stopping of the spin basket but that cannot be defeated by disconnecting power from the washing machine. During a power failure or after an intentional unplugging of the washing machine, the electromagnetic lid locking mechanism will not automatically release while the spin basket is in motion.

The lid locking assembly may also include a lid switch providing a lid closed signal when the lid is closed. The logic circuitry may receive the lid closed signal and provide power to the motor only when the lid switch indicates that the lid was closed.

Thus, it is yet another object of the invention to reduce the chance of entrapment of a small child if the lid were to close on the child at a time after the spin cycle signal was generated by the machine controls. The present logic circuitry provides this additional feature with a cost effective small addition of parts.

The foregoing and other objects and advantages of the invention will appear in the following description. The description is that of a preferred embodiment which does not necessarily represent the full scope of the invention. The scope of the invention is described by the concluding claims.

BRIEF DESCRIPTION OF THE SEVERAL VIEWS OF THE DRAWINGS

FIG. 4 is a figure similar to that of FIG. 3 showing the rotating locking bolt and ward plate in a second locked position holding the washing machine lid closed;

FIG. 5 is a simplified schematic diagram of the logic circuitry used to control the washing machine of FIG. 1 and electromechanical elements of FIG. 2;

DETAILED DESCRIPTION OF THE INVENTION

Figure 1:
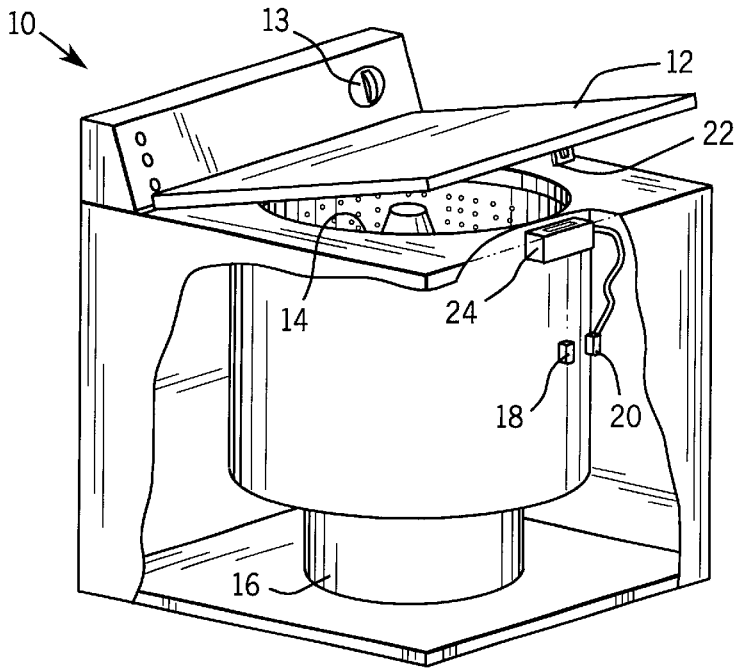
FIG. 1 is a perspective view of a top loading washing machine showing placement of the lid locking assembly of the present invention beneath the lid and a rotation sensor near the spin basket.

Referring now to FIG. 1, a washing machine 10 includes a lid 12 hinged at a rear edge to open over a spin basket 14 into which wet clothes may be received. During a spin cycle timed by a timer 13 on a rear console of the washing machine 10, the clothes in the spin basket 14 are to be spun about a vertical axis by a drive motor assembly 16 to centrifugally extract water from the clothes.

An outer surface of the spin basket 14 supports a magnet 18 which, when the spin basket 14 rotates, passes a sensor 20 attached to the stationary housing of the washing machine 10. The sensor 20 may be a magnetic reed switch closing in response to the approach of the magnet 18 such as will occur periodically during rotation of the spin basket 14.

In an alternative embodiment, the magnet 18 and sensor 20 are attached to components of the drive motor assembly 16 that move with respect to one another as the spin basket 14 rotates but that are not affected by any eccentricity in spin basket rotation.

An eye 22 extending downward from the front edge of the lid 12, opposite the hinging edge, may be received by a latch assembly 24 when the lid 12 is in a closed position.

As will be described in detail below, the latch assembly 24 includes a locking bolt that may engage the eye 22 thereby locking the lid 12 in its closed position preventing access to the spin basket 14 by the user. The mechanism is similar to that described in U.S. Pat. No. 5,520,424 issued May 28, 1996 and entitled: "Tamper-Proof Door Switch and Latch Device" and hereby incorporated by reference.

Figure 2:
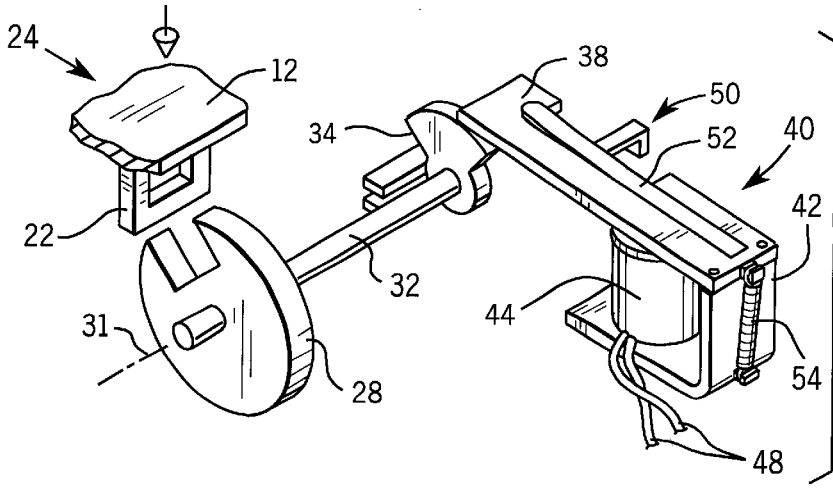
FIG. 2 is a simplified perspective view of the electromechanical elements of the lid locking assembly of the present invention showing a rotating locking bolt for engaging an eye on the washing machine lid, the locking bolt attached to rotate in tandem with a ward plate interacting with contacts and an electrically operated stop.
Figure 3:
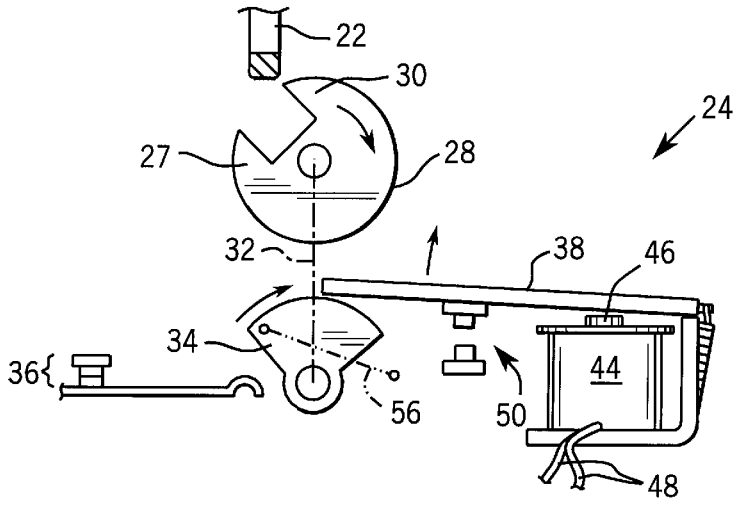
FIG. 3 is a fragmentary elevational view of the rotating locking bolt and ward plate of FIG. 2 in a first unlocked position allowing opening and closing of the washing machine lid.

Referring now generally to FIGS. 2 through 4, the latch assembly 24 includes a locking bolt 28 mounted to rotate generally about a horizontal axis 31 and having an upper tooth 30 that may engage the eye 22. When the lid 12 is open, the locking bolt 28 is rotated so that the tooth 30 is tipped upward to allow the eye 22 to move downward past the tooth 30 unimpeded with a closing of the lid 12 as shown in FIG. 3. When the lid 12 is closed, pressure of the eye 22 against a lower lip 27 of the locking bolt 28 rotates the locking bolt 28 to bring the tooth 30 through the eye 22. After the lid 12 is closed, the eye 22 may not be freed to open the lid 12 without counter rotation of the locking bolt 28 caused by upward pressure on the tooth 30 by the eye 22.

The locking bolt 28 is joined by means of a shaft 32 to a ward plate 34 which rotates in tandem with the locking bolt 28. In a preferred embodiment, the ward plate 34 is a 90 degree sector of a circular disk. As such, the shaft 32 is attached to the center of the disk, perpendicular to the face of the disk. In the open position shown in FIG. 3, the ward plate 34 has its left and right radial faces oriented at approximately plus and minus 45 degrees from vertical. In the closed position of FIG. 4, the right face of the ward plate 34 is vertical and the left face of the ward plate 34 is substantially horizontal.

A return spring 56 connects to the ward plate 34 at a point near the top of its left wall at a point fixed with respect to the ward plate 34 and so that the line between these points passes above the axis of rotation 31 to provide a clockwise return torque to the ward plate 34. Thus, ward plate 34 and locking bolt 28 will move to a fully open position absent the influence of the eye 22.

Positioned beneath the left face of the ward plate 34 is a contact set providing a "lid closed" switch 36 which in the open position of FIG. 3 is closed but which is opened by pressure of the left face of the ward plate 34 on the support of the bottom contact of the "lid closed" switch 36, when the lid 12 is closed. Thus, "lid closed" switch 36 provides an indication that the lid 12 is closed.

Positioned over the top of the ward plate 34 is one end of an armature 38 of an electrically actuated stop 40. The armature 38 is hinged at its other end removed from the ward plate 34, to a coil frame 42 which supports an electromagnet coil 44 positioned about a vertical core 46 positioned beneath the armature 38. Core 46 is a permanent magnet insufficiently strong to attract armature 38 downward alone, but sufficient to hold armature 38 downward once contact between armature 38 and core 46 has been obtained. Alternatively, the core 46 may be a high remnant magnetizable material that will retain sufficient magnetization to hold the armature in a closed position.

A first polarity of electrical current passing through leads 48 of the coil 44 will produce a magnetic field such as will augment the magnetic field retained by the core 46 (or reverse the magnetization of the core 46 in the case of the high remnant magnetizable material), and will thereby attract armature 38 downward toward the top of core 46. Once so attracted, the armature 38 will remain in the downward position held by the magnetism of the core 46. A second polarity of electrical current, opposite to that of the first polarity of electrical current drawing the armature 38 downward, will release the armature 38 to move upward as biased by a spring 54.

Figure 8:
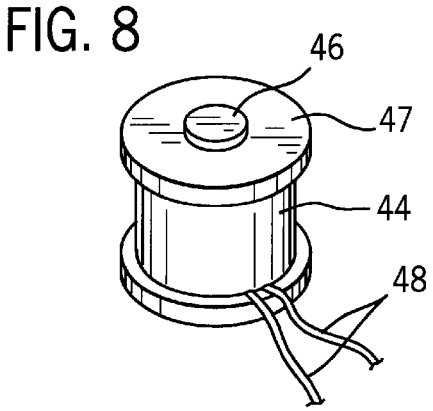
FIG. 8 is a detail view of an alternative embodiment of an electromagnet coil shown in FIGS. 2–4 using a donut shaped permanent magnet.

Referring now to FIG. 8 in an alternative embodiment, a donut of permanent magnet material 47 may be placed about the core 46 to provide the necessary magnetic attraction instead of or in addition to the core 46.

When the lid 12 is in the open position as shown in FIG. 3, armature 38 may not be drawn downward into contact with core 46 because the free end of the armature 38 strikes the upper circumference of the ward plate 34. In the closed position of FIG. 4, however, the ward plate 34 has rotated such that armature 38 may move downward into contact with core 46 and, in doing so, the end of armature 38 is in a position to abut the right most wall of ward plate 34 preventing counter rotation to the open position of FIG. 3. As a result of the inner connection between the ward plate 34 and the locking bolt 28, the locking bolt 28 may not rotate when armature 38 is drawn downward against core 46 and locking bolt 28 therefore holds lid 12 closed in a locked position as a result of its inner action with the eye 22. Thus, this first polarity of electrical current may be termed a lock signal and the latch assembly 24 may be considered to be in a locked state when the armature 3 8 is attracted to the core 46.

Referring to FIG. 4, once armature 38 has been drawn down to core 46, power may be disconnected from leads 48 and yet armature 38 will remain downward held by the residual magnetism of core 46 or the donut 47.

The latch assembly 24 may be released by moving the armature 38 upward again by means of applying to leads 48 the second polarity of current previously described which causes the coil 44 to produce a magnetic field opposing that of the core 46 or donut 47 releasing the armature 38. This second polarity of electrical current is termed the unlock signal. The latch assembly 24 may be considered to be in an unlocked state when the armature 38 is released from the core 46.

Again, when power is disconnected from leads 48, the armature 38 will remain in an upward position held by the biasing spring 54. Thus, it will be noted that the latch assembly 24 is bistable requiring no power to remain in either the unlocked or locked state and remaining in the last unlocked or locked state indefinitely when power is removed.

A contact set forming a "lock enabled" switch 50 has one contact supported at the lower surface of armature 38 by a cantilevered contact support spring 52 (visible in FIG. 2) and the other contact positioned beneath the armature 38 so that the contact set is open when the armature 38 is in an unlocked state shown in FIG. 3 and closed when the armature 38 is in a locked state shown in FIG. 4. "Lock enabled" switch 50 provides a signal indicating that a locking has occurred as opposed to simply a closure of the lid 12 and allows the motor of drive motor assembly 16 to run.

Figure 6:
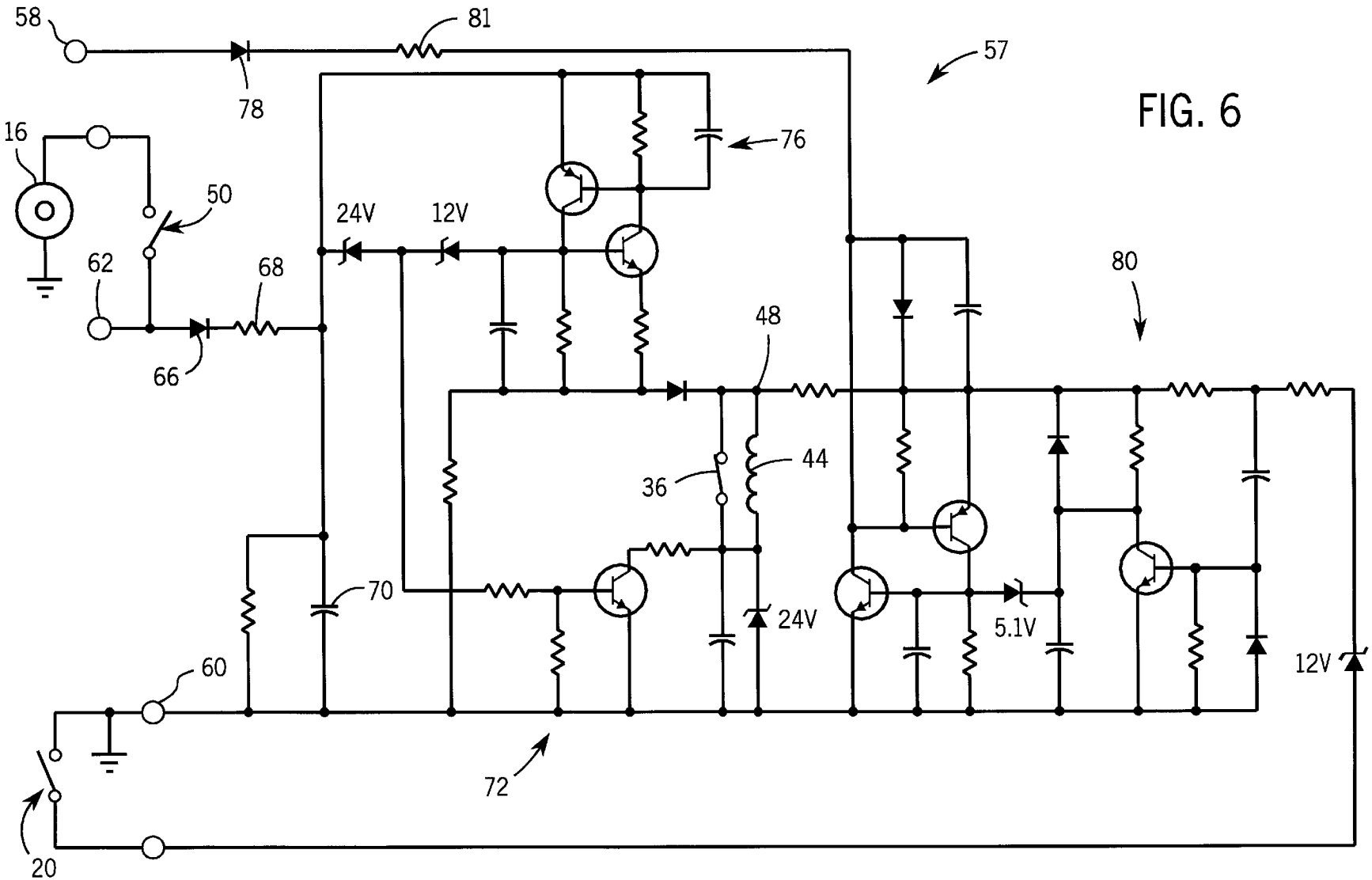
FIG. 6 is a detailed schematic diagram of the logic circuitry of FIG. 5.

Referring now to FIGS. 5 and 6, the mechanical elements of the latch assembly 24 described in FIGS. 2 through 4 are controlled by logic circuitry 57 receiving AC power from a power line 58 (that generally provides switched power to the washer 10) and completing a circuit through a ground 60. The washing machine timer 13 (shown generally in FIG. 1) provides a spin cycle signal 62 in the form of AC voltage when the spin basket 14 is to be spun by drive motor assembly 16.

During operation of the washing machine 10, the spin cycle signal 62 is received by a terminal 64 on the housing 55 of the latch assembly 24. The terminal connects the spin cycle signal 62 through the "lock enabled" switch 50 to a second terminal connected to the motor of the drive motor assembly 16. In the unlocked state, "lock enabled" switch 50 is open and therefore no current passes to the motor of the drive motor assembly 16.

The spin cycle signal 62 also connects through diode 66 and limiting resistor 68 to a "lock signal" capacitor 70 which, when the spin cycle signal 62 is present, begins charging. The charging is indicated by arrow 73. During this charging, "lock signal" capacitor 70 stores energy that will be shunted through the coil 44 of the latch assembly 24 to lock that mechanism as has been described and also provides a timing signal by means of its decreasing voltage as it discharges. Specifically, when the charge on capacitor 70 climbs to a first predetermined level of approximately 24 volts, it actuates switching circuit 72. Switching circuit 72 is connected to shunt an "unlock signal" capacitor 74 discharging that capacitor 74 when switching circuit 72 is actuated.

The "unlock signal" capacitor 74 is connected between ground, on one side, and a junction between "lid closed" switch 36 and coil 44 on the other side. The "lid closed" switch 36 and coil 44 are connected in parallel and their other end is connected through switching element 76 to the side of the "lock signal" capacitor 70 receiving current from limiting resistor 68.

When "lock signal" capacitor 70 reaches a second voltage (approximately 36 volts) greater than the voltage triggering switching circuit 72, switching element 76 conducts allowing current to flow from "lock signal" capacitor 70 through coil 44 (if the lid is closed and "lid closed" switch 36 is open) into "unlock signal" capacitor 74 which was previously discharged as indicated by arrow 77. When the lid 12 is closed, this current from the "lock signal" capacitor provides the lock signal causing armature 38 (shown in FIG. 4) to be drawn downward locking the lid 12 in the locked position. The latching of armature 38 closes "lock enabled" switch 50 which allows current to flow to motor of the drive motor assembly 16.

Note that if the lid 12 is open at the time the spin signal is received, such as would indicate a child may be entrapped, then "lid closed" switch 36 is closed and the current passes solely through short circuit created by "lid closed" switch 36. In this case, the armature 38 is not drawn downward into the locking position.

As the voltage on "lock signal" capacitor 70 drops with its discharge, switching circuit 72 opens allowing a charge to accumulate on the "unlock signal" capacitor 74 from the flow of current along path 77. "Unlock signal" capacitor 74 provides a reserve of power that will be used to unlock the latch assembly 24 at the end of a coast down after the spin cycle or in the event of a power failure both as will be described. The transfer of power from "lock signal" capacitor 70 to "unlock signal" capacitor 74 ensures that any time sufficient power is available to lock the latch assembly 24 that reserved power exists to unlock the latch assembly 24 and the form of charge on "unlock signal" capacitor 74. While power is available to the washing machine 10, as is normally the case, the charge on "unlock signal" capacitor 74 is maintained by a path from the power line 58 through diode 78 and limiting resistor 81, through coil 44 or "lid closed" switch 36.

At the conclusion of the spin cycle, the spin cycle signal 62 is disconnected and switching element 76 resets to an open state. When the spin basket 14 has coasted to a stop, switching element 80, which is connected between the side of the parallel connection of "lid closed" switch 36 and coil 44 that receives power from the spin cycle signal 62 and ground, serves to provide a discharge path for the energy in the "unlock signal" capacitor 74 backwards through coil 44 to ground in order to produce the unlock signal to unlock the latch assembly 24. Thus energy from the lock signal may be recycled as an unlock signal later if power is lost.

Switching element 80 provides a discharge path for "unlock signal" capacitor 74 if a periodic signal of a predetermined rate (rotation signal 21) is no longer received from sensor 20. Sensor 20 provides a path from switching element 80 to ground each time the magnet on the spin basket 14 passes the sensor 20 as the spin basket 14 spins.

The "unlock signal" capacitor 74 effectively powers the switching element 80 and its associated logic circuitry in the event of a power failure.

When switching element 80 moves to a conducting state, it oscillates between a conducting and non-conducting condition such as allows capacitor 74 to slowly recharge (if power is available) and then rapidly discharge through switching element 80 providing repetitive unlock signals through coil 44. Such repetitive signals ensure that coil 44 unlocks in the unlikely event that one or more unlocking signals are jammed, for example, by the user pulling upward on the lid 12 such as may cause the armature 38 to be trapped against the ward plate 34 as shown in FIG. 4.

Note that if the wire from sensor 20 is broken, then shortly after the spin cycle is initiated, the "unlock signal" capacitor will charge up by virtue of the locking signal and an unlock signal may be produced by switching element 80. This unlock signal will open "lock enabled" switch 50 stopping the spinning of the motor despite the presence of the spin cycle signal 62. This stopping of the motor of the drive motor assembly 16 provides an indication to the user that a repair is required and avoids needless exposure of the user to the rotating spin basket 14 when the circuit cannot maintain a lock state for lack of information about whether the spin basket 14 is in motion.

Figure 7:
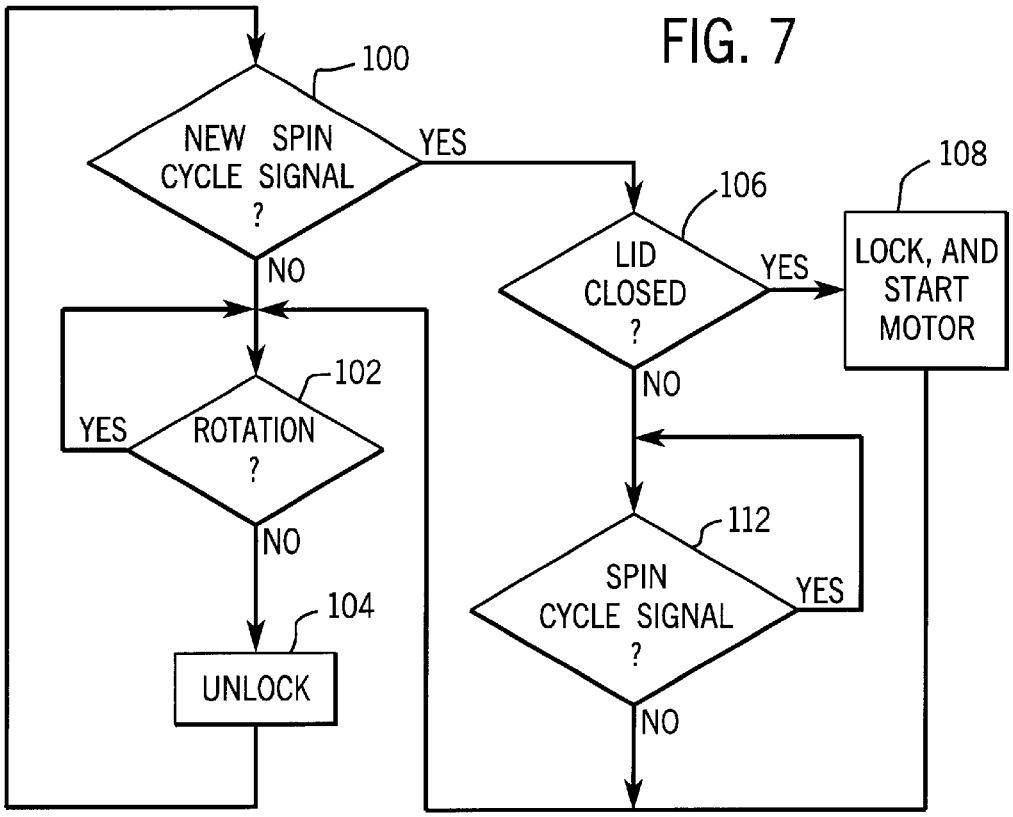
FIG. 7 is a flow chart describing the operation of the logical circuitry of FIG. 5 when connected in a washing machine.

Referring now to FIG. 7, the circuit of FIGS. 5 and 6 initially detects the initiation of a new spin cycle signal at decision block 100. A new spin cycle in this case indicates a transition from no spin cycle to a spin cycle signal.

If there is no new spin cycle signal during a washing cycle, the circuit proceeds to decision block 102 to determine whether the spin basket 14 is rotating as detected by sensor 20. If not, as would also be the case, for example, in a wash cycle, the circuit proceeds to process block 104 and an unlock signal in the form of a pulse is transmitted to the coil 44 of the electrically actuated stop 40 and the circuit returns back to the decision block 100. Thus, in situations where a lid lock is not required, that is, there is no spin cycle and the spin basket 14 is not rotating as might be the case in a recently concluded spin cycle, the electrically actuated stop 40 receives repeated unlocked pulses to ensure that the latch assembly 24 is unlocked.

Upon an initiation of a spin cycle signal at decision block 100, the circuit moves to decision block 106 where it is determined whether the lid 12 is closed (by means of "lid closed" switch 36). If the lid 12 is closed, the circuit proceeds to process block 108 and the lid 12 is locked by actuation of coil 44 of electrically actuated stop 40 which in turn closes "lock enabled" switch 50 allowing the motor to start. The circuit then proceeds to decision block 102 as has been described to test for rotation of the motor.

Normally at decision block 102, there will be rotation detected because the motor of the drive motor assembly 16 was started at process block 108 and the sensor 20 is properly connected and therefore the circuit loops back to the top of decision block 102 and continues to cycle through decision block 102 for as long as the spin basket 14 is rotating.

When the spin cycle ends, the motor of the drive motor assembly 16 no longer receives power and the spin basket 14 begins to coast. When rotation is no longer detected by sensor 20, the circuit breaks out of the loop of decision block 102 and proceeds to process block 104 where the latch assembly 24 is unlocked. The circuit then begins the cycling between decision block 100, decision block 102, and process block 104 as has been previously described, providing repeated unlock signals.

During spinning of the spin basket 14 when the circuit is checking rotation of the spin basket 14 at decision block 102, power may be removed from the washing machine 10 in a power failure or an attempt to defeat the lid lock. Normally the spin basket 14 will coast down prior to enough energy being lost from capacitor 74 that a lid unlocking is no longer possible.

The basic circuitry used to provide a fast release lid lock when rotation of the spin basket 14 ceases may also help prevent entrapment of a small child if the lid is closed while the spin cycle is activated. Referring still to FIG. 7, in this circumstance, at process block 100, a spin cycle signal is detected and the circuit proceeds to decision block 106. At decision block 106, the lid 12 is not closed and therefore the circuit proceeds to decision block 112 which again checks for the presence of a spin cycle signal 62. If that spin cycle signal 62 is still present, the circuit loops back to this decision block 112 indefinitely, thus avoiding a locking and starting of the motor of the drive motor assembly 16. Only when the spin cycle signal 62 is turned off and on again by the user with the lid closed, does the circuit proceed to decision block 102 to check for a rotation signal 21 per a normal end of a spin cycle, ultimately ending up again at decision block 100.

Thus, in order for the motor of the drive motor assembly 16 to be started for the spin cycle, the lid 12 must be closed prior to the initiation of the spin cycle signal 62 avoiding the entrapment situation.

Figure 9:
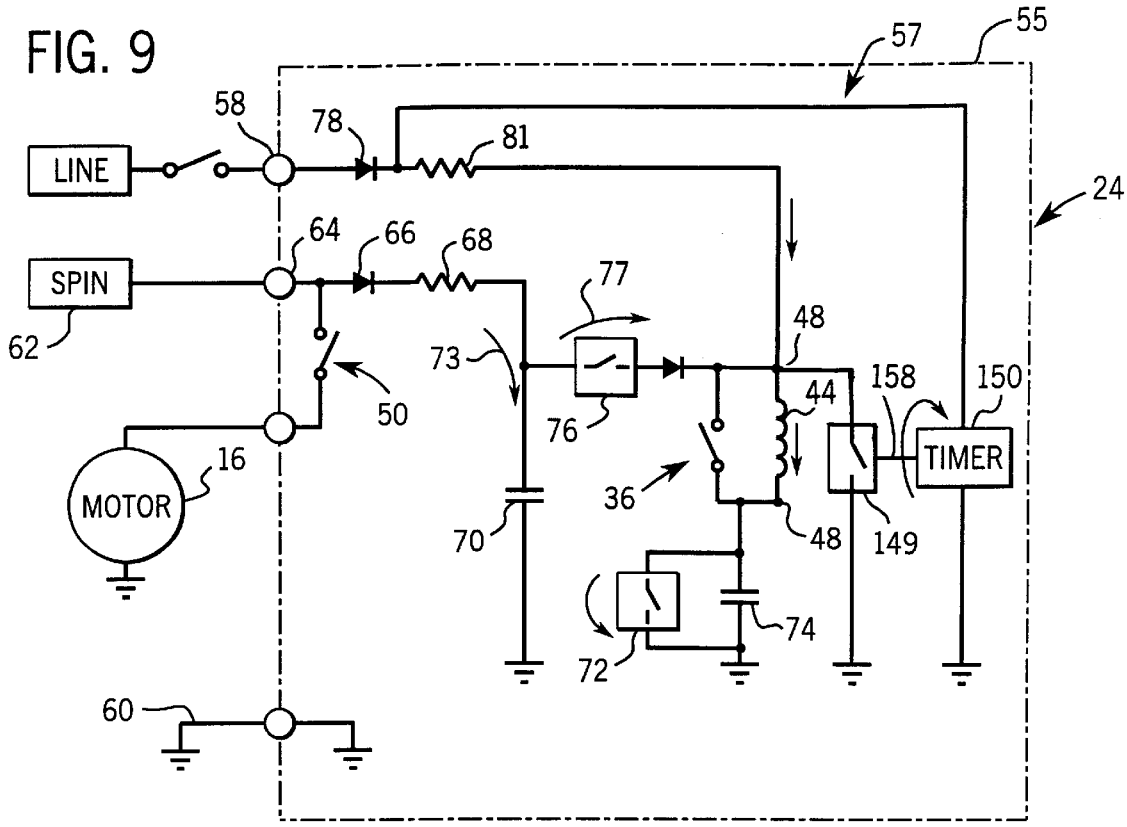
FIG. 9 is a simplified schematic diagram of an alternative of the logic circuit used to control the washing machine of FIG. 1 and electromechanical elements of FIG. 2 without a spin sensor.

In an alternative embodiment shown in FIG. 9, the spin sensing switching element 80 and sensor 20 are eliminated and a timer 150 used instead. The timer 150 provides an unlock signal 158 to a switching circuit 149, the latter which shunts one end of coil 44 to ground, the other end being connected to capacitor 74 so that the discharge of capacitor 74 through coil 44 causes an unlatching of the latch assembly 24.

Figure 11:
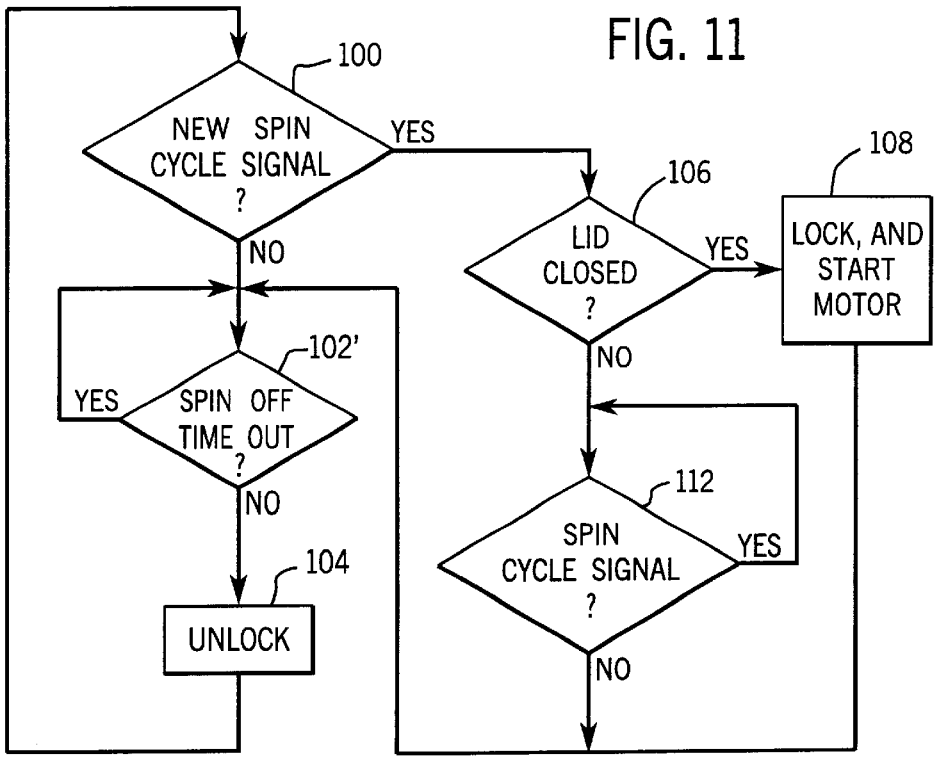
FIG. 11 is a flow chart describing the operation of the logical circuitry of FIG. 9 when connected in a washing machine.

Referring also to FIG. 11, the operation of this alternative embodiment is essentially the same as that described above with respect to FIGS. 5–7 except at process block 102 (now labeled 102') rotation is not sensed, but a fixed period of time after the cessation of the spin cycle signal is sensed. This fixed period of time is set to approximate the maximum time of coasting rotation of the spin basket under variations in load, weight, speed and friction and inertia for the spin basket, once power to the motor 16 has stopped. When this period of time has elapsed, the lid may be opened in much the same way as when the sensor 20 of the previous embodiment indicated that spinning of the spin basket 14 had stopped.

Figure 10:
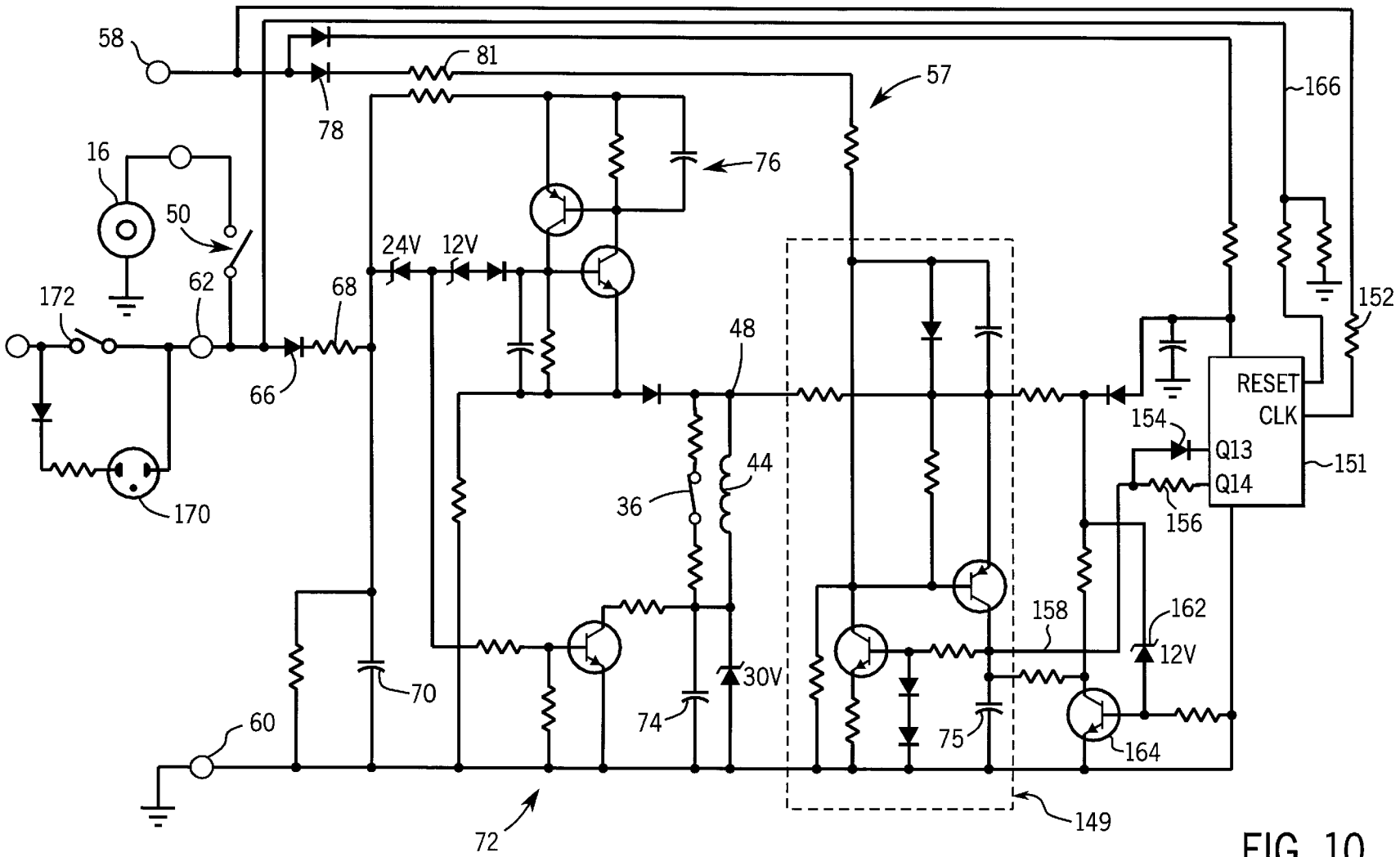
FIG. 10 is a detailed schematic diagram of the logic circuitry of FIG. 9.

Referring now to FIG. 10, the timer 150 may be a digital counter 151 such as a 4020 integrated circuit well known in the art, receiving at its clock input (CLK) from the AC voltage of the power line 58 attenuated by attenuating resistor 152. In this manner, the counter counts cycles of the 60 Hz voltage of power line 58. Outputs Q13 and Q14 of the counter representing count values of $2^{11}$ and $2^{12}$ are combined by means of diode 154 and resistor 156 acting as a simplified AND gate to provide a unlock signal 158 to the switching circuit 149.

The counter 151 is held reset by line 166 communicating with the spin cycle signal 62 so as to hold the counter at a count value of zero until the spin cycle has ceased. Then the counter begins counting and when the Q13 and Q14 outputs go high (representing a count of 6,144 line cycles or 102.4 seconds), the unlock signal is generated activating the shunting circuitry 149 pulling down the lead 48 of coil 44 attached to capacitor 74 to ground causing an unlock signal to pass through coil 44. Capacitor 75 causes a two second delay in the unlocking action.

In the event of a power failure, the voltage on capacitor 74 is monitored by zener diode 162 which ceases conducting as the voltage on zener diode 162 drops below a predetermined threshold. This ceasing of conductance turns off transistor 164 asserting the unlock signal 158 and causing unlocking of the latch despite the loss of power to the counter 151. The time constant for the decay of the voltage on capacitor 74 to the predetermined threshold is set to be nominally 250 seconds so, even with long term capacitor degradation of up to 50% and a tolerance factor of 10%, the time constant is substantially longer than that which would be provided by the operation of counter 151. Thus in the event of power failure, access to the clothes is allowed, albeit at a time somewhat after access would be allowed were the counter 151 working, ensuring that the spin basket 14 has stopped spinning.

If power line 58 has been disconnected, the occurrence of the unlock signal causes capacitor 74 to fully discharge and only a single unlock pulse is produced. If however power is still present through the power line 58, capacitor 74 recharges as described above and switching circuit 151 is reset to be reactivated upon the recharging of capacitor 74 to produce a series of unlock signals ensuring complete unlocking.

A neon bulb 170 or other indicator light is placed in series about contacts 172 of the cycle timer 13 whose closure creates the spin cycle signal 62 so as to illuminate when the spin cycle is complete providing a visual indication to the user that the spin mode has ended and that the spin basket 14 is coasting to a stop with the lid locked.

The above description has been that of a preferred embodiment of the invention. It will occur to those that practice the art that many modifications may be made without departing from the spirit and scope of the invention. In order to apprise the public of the various embodiments that may fall within the scope of the invention, the following claims are made.

We claim:

1. In a washing machine having a lid that may be opened to provide access to a spin basket and closed to prevent access to the spin basket, the spin basket being driven by an electric motor when a spin cycle signal from a spin cycle timer is present, a lid locking assembly comprising:

(a) a bistable electromagnetic lid locking mechanism, in a locked state, holding the lid closed until an unlock signal is received and in an unlocked state allows the lid to be freely opened until a lock signal is received, and where the unlock and lock signals are power applied to the electromagnetic lid locking mechanism and wherein, absent power applied to the electromagnetic lid locking mechanism, the electromagnetic lid locking mechanism remains in its last state of locked and unlocked; and (b) a logic circuit including a timer and an energy storage capacitor to provide the unlock signal to the electromagnetic lid locking mechanism a predetermined period of time after the cessation of the spin cycle signal, wherein the storage capacitor provides energy for the unlock signal in the event of loss of external power to the washing machine.

2. The lid locking assembly of claim 1 wherein the electromagnetic lid locking mechanism includes a locking bolt moving to engage and disengage with the lid when the lid is in the closed and open state, respectively, and an electrically operated stop having a tooth received by the locking bolt to prevent movement of the locking bolt when the tooth is so received, the electrically operated stop receiving a first polarity electrical signal as the unlock signal to withdraw the tooth from the locking bolt and receiving a second polarity electrical signal as the lock signal to insert the tooth into the locking bolt.

3. The lid locking assembly of claim 2 wherein the electrically operated stop includes a permanent magnet holding the tooth against movement after a lock signal is received.

4. The lid locking assembly of claim 2 including additionally:

(d) a lid switch providing an indication of whether the lid is closed; wherein the lid switch is wired to the electrically operated stop to prevent current flow through the electrically operated stop when the lid is open.

5. The lid locking assembly of claim 1 wherein energy stored in the storage capacitor for the unlock signal is from a previous lock signal.

6. The lid locking assembly of claim 1 wherein the timer is a digital counter counting a predetermined number of cycles of line voltage.

7. The lid locking assembly of claim 1 including additionally:

(d) a lid switch providing a lid closed signal when the lid is closed; and (e) a motor control contact controlling power to the electric motor driving the spin basket; and wherein the logic circuitry, receives the lid closed signal and closes the motor control contacts to provide power to the electric motor only when the lid switch indicates the lid was closed prior to the time the spin cycle signal was received and that the lid remained closed until the spin cycle signal was received.

8. The lid locking assembly of claim 1 wherein the logic circuitry applies repeated unlock signals to the electromagnetic lid locking mechanism while external power is present at a predetermined period of time after the cessation of the spin cycle.

9. The lid locking assembly of claim 1 wherein the logic circuit further includes a voltage monitor monitoring the voltage on the storage capacitor and providing the unlock signal when a predetermined voltage drop has been exceeded indicating an imminent loss of sufficient energy for the unlock signal.

10. The lid locking assembly of claim 1 wherein the logic circuit further includes a second timer providing an unlock signal to the electromagnetic lid locking mechanism a second predetermined period of time after the loss of external power.

11. The lid locking assembly of claim 10 where the second timer includes a voltage monitor monitoring the voltage on the storage capacitor to determine a time interval.

12. The lid locking assembly of claim 11 where the second timer includes a voltage monitor monitoring the voltage on the storage capacitor to determine a time interval.

13. The lid locking assembly of claim 1 including an indicator light and wherein the logic circuit illuminates the indicator light after completion of the spin cycle while the lid remains locked.

* * * * *

UNITED STATES PATENT AND TRADEMARK OFFICE

CERTIFICATE OF CORRECTION

PATENT NO. : 6,363,755 B1
DATED : April 2, 2002
INVENTOR(S) : Hapke et al.

It is certified that error appears in the above-identified patent and that said Letters Patent is hereby corrected as shown below:

Column 10,
Line 62, delete claim 13 and replace with:
-- 13. The lid locking assembly of claim 12 wherein the second predetermined time is longer than the first predetermined time. --

Signed and Sealed this

First Day of October, 2002

*Attest:*

*Attesting Officer*

JAMES E. ROGAN
*Director of the United States Patent and Trademark Office*